US005913775A

United States Patent [19]

Delamare

[11] Patent Number: 5,913,775

[45] Date of Patent: Jun. 22, 1999

[54] INFLATABLE ROOF WHICH CAN BE UNFOLDED AND FOLDED AWAY

[75] Inventor: Guy Delamare, Le Peck, France

[73] Assignee: Societe Civile D'Exploitation des Brevets et Procedes Spironef, Paris, France

[21] Appl. No.: 08/930,070

[22] PCT Filed: May 22, 1996

[86] PCT No.: PCT/FR96/00765

§ 371 Date: Mar. 4, 1998

§ 102(e) Date: Mar. 4, 1998

[87] PCT Pub. No.: WO96/38642

PCT Pub. Date: Dec. 5, 1996

[30] Foreign Application Priority Data

May 31, 1995 [FR] France ..... 95/06488

[51] Int. Cl.[6] ..... E04B 1/28; E04B 1/32; E04B 1/342; E04B 1/343

[52] U.S. Cl. ..... 52/2.11; 52/2.24; 52/66; 52/81.4; 52/82; 52/86; 52/88

[58] Field of Search ..... 52/2.11, 2.24, 52/66, 81.4, 82, 86, 88

[56] References Cited

U.S. PATENT DOCUMENTS 4,317,315 3/1982 LeBlang ..... 52/2.24 X

FOREIGN PATENT DOCUMENTS 566745 9/1975 Switzerland ..... 52/2.24

*Primary Examiner*—Christopher Kent

*Attorney, Agent, or Firm*—Wenderoth, Lind & Ponack, L.L.P.

[57] ABSTRACT

An inflatable roof (1), which can be unfolded and folded away by respectively inflating and deflating it, includes a plurality of longitudinal inflatable beams A, B, C . . . arranged side by side, a mechanism (4) for supplying the inflatable beams with pressurized fluid, and a mechanism for sliding the beams along at least one unfolding or folding-up track (2, 2*a*) formed by a rigid beam sealingly passing through the inflatable beams. The rigid beam is formed by a pipe (3) for conveying pressurized fluid for inflating or deflating the beams. The pipe communicates at least at one of its ends, with the pressurized-fluid supply mechanism (4), and with the interior of at least one inflatable beam via at least one orifice (5, 5*a*, 5*b* . . . ) formed in the wall of the pipe (3). The pipe is equipped with a device or devices for blocking off the at least one orifice.

24 Claims, 14 Drawing Sheets

INFLATABLE ROOF WHICH CAN BE UNFOLDED AND FOLDED AWAY

BACKGROUND OF THE INVENTION

The subject of the present invention is an inflatable roof, which can be unfolded and folded away by respectively inflating and deflating it.

In general, these inflatable roofs include a plurality of longitudinal beams arranged side by side, means for sliding at least first end of the beams along at least one unfolding or folding-up track and means for supplying the beams with pressurized fluid.

This type of roof is known, among others, to allow it to be unfolded simply by inflating and folded away by deflating. This makes it possible, as required, to cover over a space for the purpose of protecting it from the elements and to uncover it in fine weather.

FR-A-2 621 944 more particularly discloses an inflatable roof in which each beam comprises two opposed panels forming a flange and each constituting one of the lobes of the interior and exterior wall of the roof and two side panels forming the web of the beam.

The means for supplying the beam with inflating fluid are formed by at least one conduit which passes through the beams and can be extended along its length, its extension and its retraction being respectively controlled by the unfolding and folding-away of the roof.

In this roof, the supply conduit is common to all beams and communicates with each of the beams via a blockable orifice controlled by blocking-off means and the supply conduit sealingly passes through an opening made in each of the side panels.

The unfolding track is located outside the beams, which leads to stresses distributed over a small area of the wall.

FR-A-2,677,394 also discloses an inflatable roof comprising a plurality of longitudinal beams arranged side by side, means for sliding at least first end of the beams along at least one unfolding or folding-up track and means for supplying the beams with inflating fluid.

In this case, the unfolding or folding-up track passes sealingly through the beams.

This unfolding or folding-up track extends longitudinally inside a pressurized-fluid supply conduit and the sliding means are located between the track and the wall of the conduit.

However, such a structure poses sealing problems and is complex because of the arrangement of the folding or folding-up track inside the pressurized-fluid supply conduit.

SUMMARY OF THE INVENTION

The object of the invention is to propose an inflatable roof, which can be unfolded and folded away, enabling the previously mentioned drawbacks to be avoided.

The subject of the invention is therefore an inflatable roof, which can be unfolded and folded away by respectively inflating and deflating it, comprising:

- a plurality of longitudinal inflatable beams arranged side by side,
- means for supplying the inflatable beams with pressurized fluid, and
- means for sliding the beams along at least one unfolding or folding-up track formed by a rigid beam sealing passing through these beams.

In this inflatable roof, the rigid beam is formed by a pipe for conveying the pressurized fluid for inflating or deflating the beams communicating, on the one hand, at least at one of its ends, with the pressurized-fluid supply means and, on the other hand, with the interior of at least one inflatable beam via at least one orifice made in the wall of the pipe and equipped with means for blocking it off.

Other characteristics of the invention will now be described. The pipe is formed by a tube having a circular cross-section or a rectangular cross-section. The means for supplying the inflatable beams are formed by at least one pressurized-fluid generator. The pressurized-fluid generator is a centrifugal blower comprising a suction port equipped with a first flexible duct whose free end comprises means for connection to a second flexible duct which is joined to the pipe, and a delivery port comprising means for connection to the second flexible duct which is intended to be joined alternately by the means for connection to the delivery port in order to inflate the beams, or to the free end of the first flexible duct in order to deflate the beams.

The blocking-off means is formed by sealed doors associated with means for opening them or for closing them. Each door comprises at least one leaf pivoting in the pipe between a closed position providing continuity of the external wall of the pipe and an inclined open position directing, through the orifices, the pressurized fluid from this pipe towards the at least one inflatable beam or from the at least: one inflatable beam towards the pipes. The contiguous walls of the adjacent inflatable beams are joined together around the corresponding pipe by a support plate carrying the sliding means and, together with the pipe, leaving a free space which can be blocked off momentarily by a seal. The adjacent support plates are held away from each other by at least one spacer, by a distance such that the length of the pipe between the adjacent support plates comprises at least one part of the surface of at least one of the blockable orifices.

BRIEF DESCRIPTION OF THE DRAWINGS

The invention will be more clearly understood on reading the description which follows, given solely by way of example and with reference to the appended drawings in which.

DETAILED DESCRIPTION OF THE PREFERRED EMBODIMENTS

Figure 1:
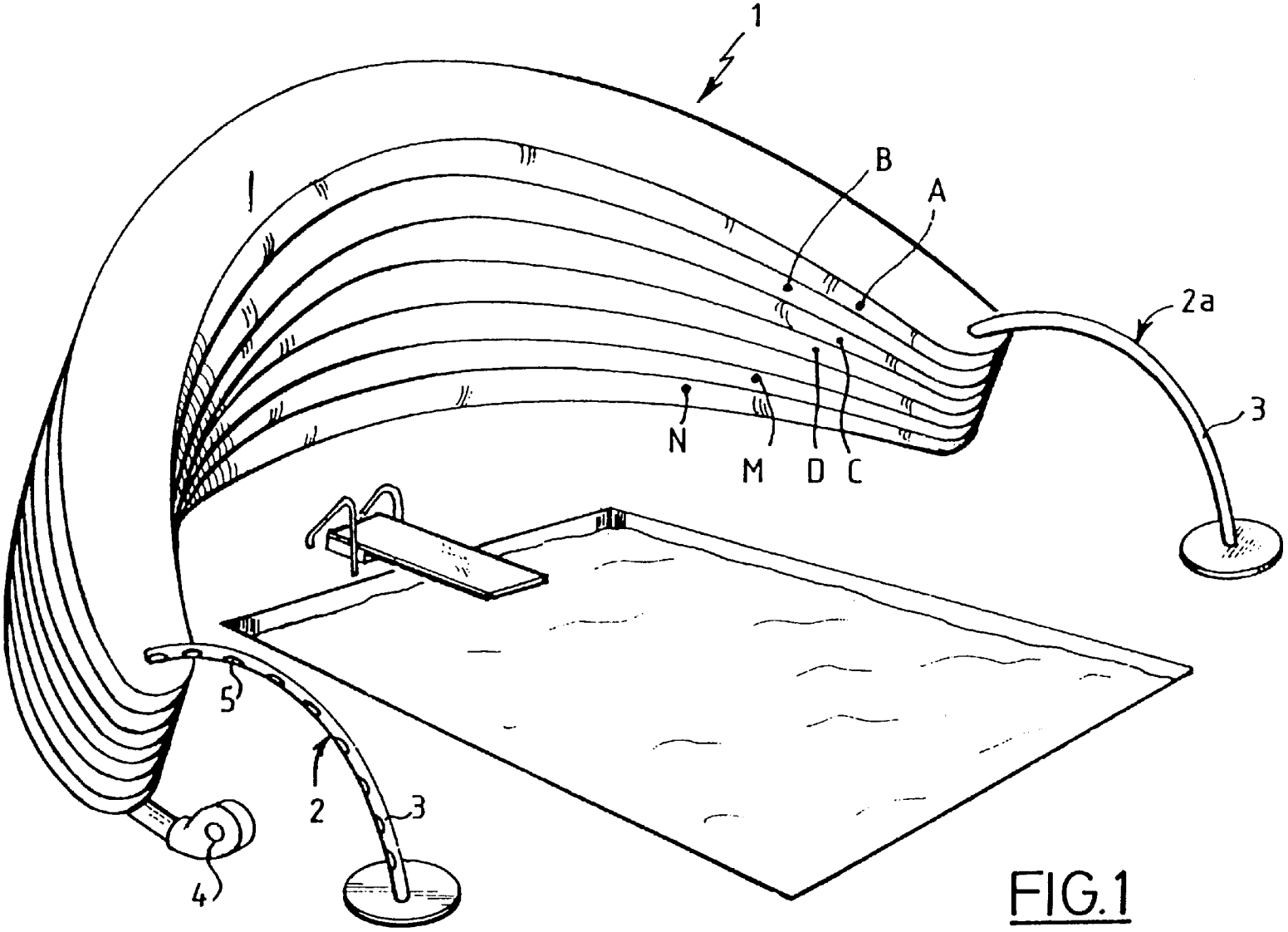
FIG. 1 is a diagrammatic perspective view of an inflatable roof according to the invention.

FIG. 1 diagrammatically depicts an inflatable roof 1 constituted by a plurality of longitudinal inflatable beams A, B, C . . . M, N which are sealed and arranged side by side in order to form the roof 1.

At the ends of the beams A, B, C . . . , the beams are mounted so as to slide along an unfolding or folding-up track 2 and 2*a* which passes through the flexible walls of the beams, as well be described later.

Each unfolding or folding-up track 2 and 2*a* is formed by a rigid beam.

One of the rigid beams, such as the rigid beam 2 for example, is formed by a pipe 3 for conveying a pressurized fluid for inflating or deflating the beams A, B, C . . .

According to an alternative form, each rigid beam may be formed by a pipe for conveying the pressurized fluid.

The pipe 3 for conveying the pressurized fluid for inflating or deflating the beams A, B, C . . . communicates, on the one hand, at least at one of its ends, with pressurized-fluid supply means 4 (FIG. 1) and, on the other hand, with the interior of at least one inflatable beam A, B, C . . . via at least one orifice 5, 5*a*, 5*b*, 5*c* . . . made in the wall of the pipe 3. Each orifice is equipped with means for blocking it off.

Figure 5:
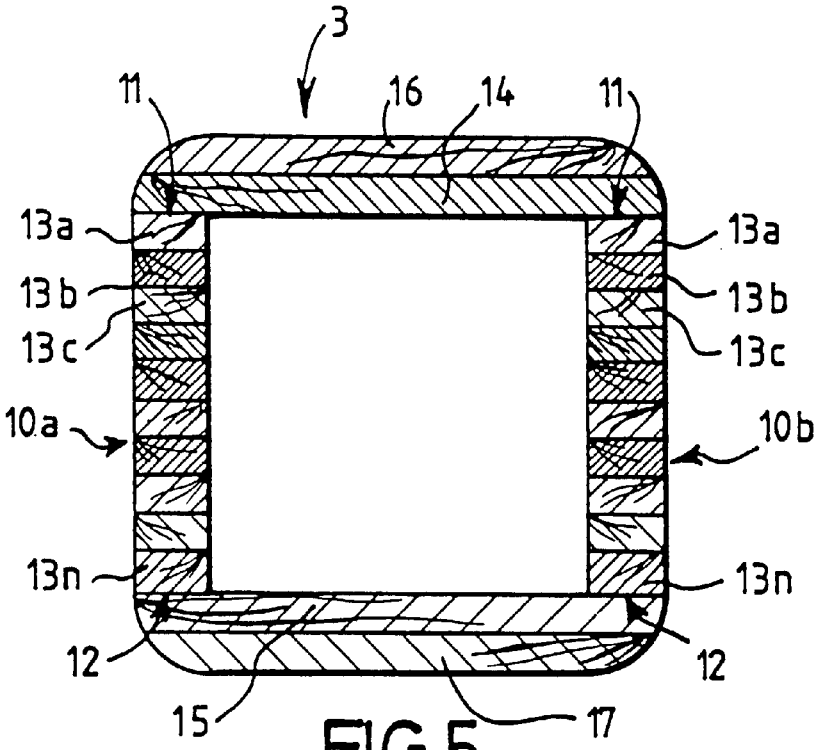
FIG. 5 is a cross-sectional view of a second embodiment of the means for sliding the inflatable beams.

The pipe 3 is formed, for example, by a straight or curved tube having a circular cross-section (FIG. 4) or by a curved tube having a rectangular cross-section (FIG. 5).

This tube may be made from wood, from a composite or alternatively from metal.

Figure 4:
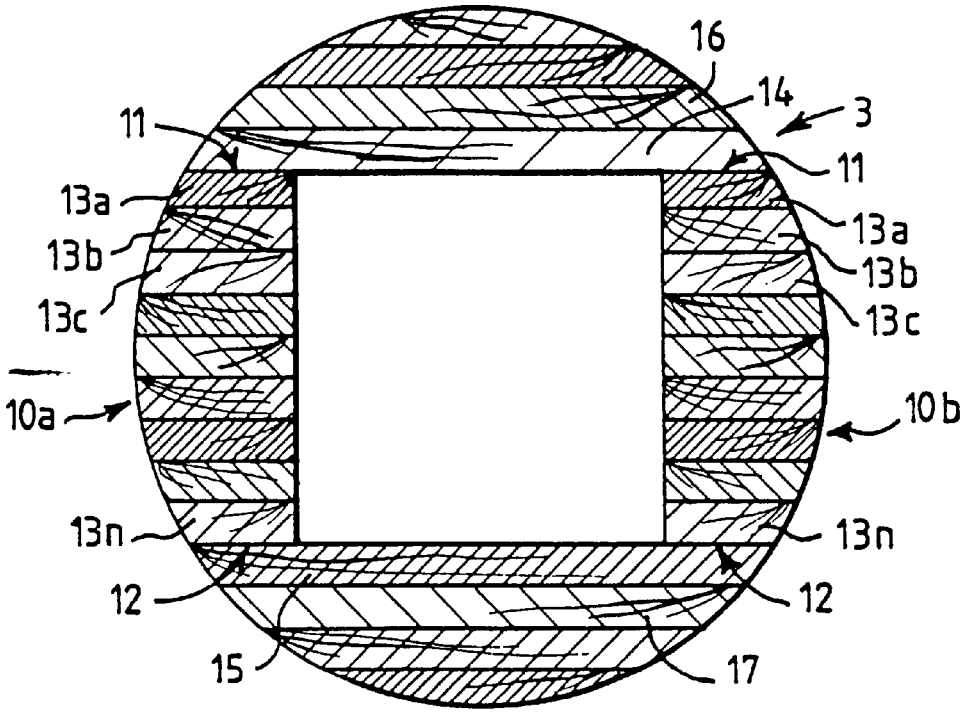
FIG. 4 is a cross-sectional view of a first embodiment of a means for sliding the inflatable beams.

According to an illustrative embodiment depicted in FIGS. 4 and 5, the pipe 3 is composed, on the one hand, of two side walls 10*a* and 10*b*, the two edges 11 and 12 of which are straight or curved and which are made by a stack of wooden strips 13*a*, 13*b*, 13*c* . . . 13*n* and, on the other hand, of at least two wooden planks 14, 15, 16 and 17 which are straight or curved and are adhesively bonded to the end face of the edges 11 and 12 of the side walls 10*a* and 10*b*.

The means 4 for supplying the inflatable beams A, B, C . . . with pressurized fluid is formed by at least one pressurized-fluid generator.

Figure 3:
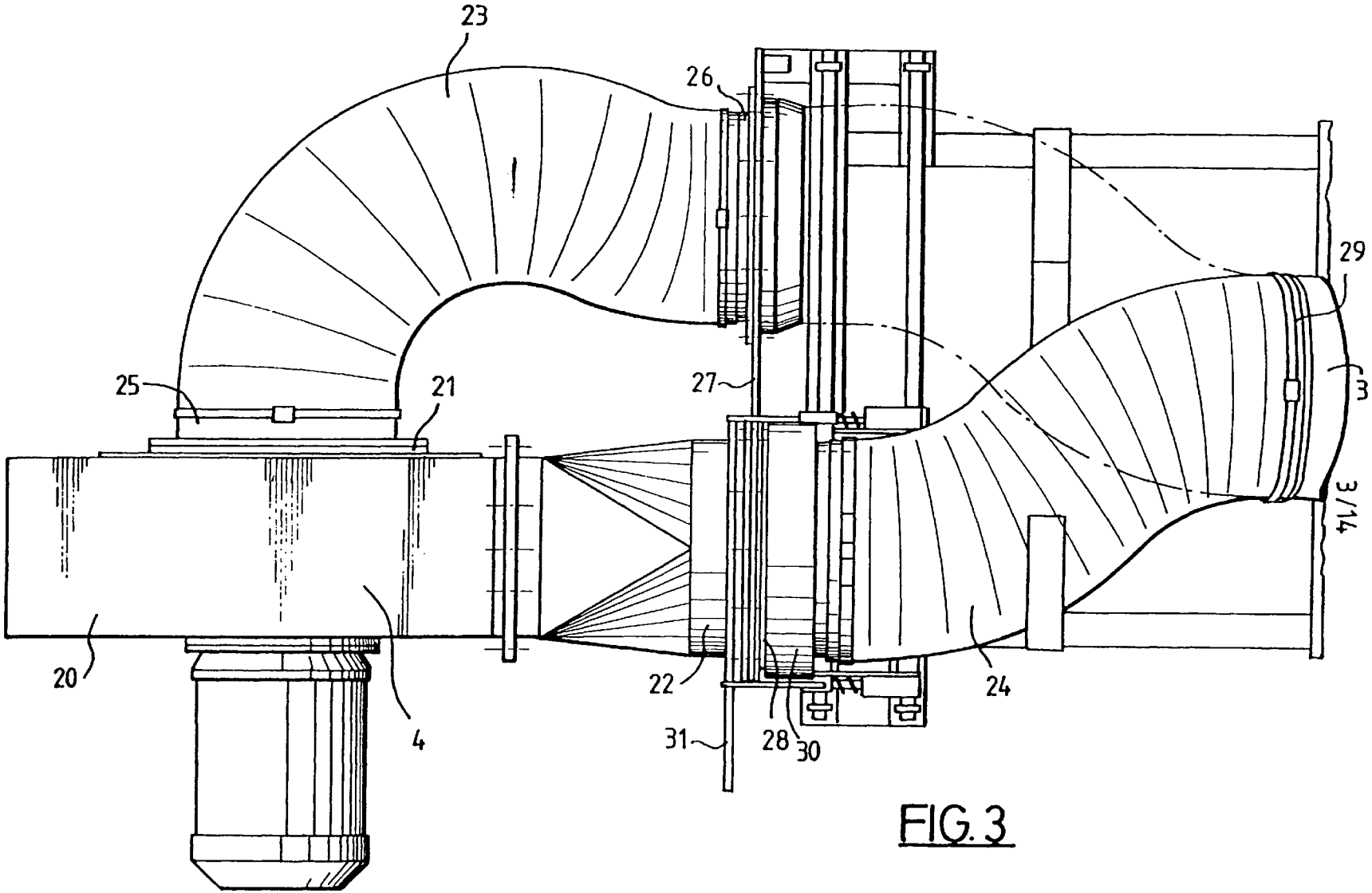
FIG. 3 is a diagrammatic view of a means for supplying the inflatable beams with pressurized fluid.

According to an illustrative embodiment depicted in FIG. 3, the pressurized-fluid generator is a centrifugal blower 4 which includes a suction port 21 and a delivery port 22.

The suction port 21 and the delivery port 22 are respectively joined to the pipe 3 by means of two flexible ducts 23 and 24.

The first flexible duct 23 has its two ends joined to stationary fixtures 25 and 26. The fixture 25 is fixed on the suction port 21 and the fixture 26 is carried by a support plate 27 mounted on the delivery port 22 by means of a fixture 28.

The second flexible duct 24 has one of its ends joined to a stationary fixture 29 fastened to the pipe 3 and the other of its ends joined to a movable fixture 30 associated with an operating means 31 allowing sealed connection of the second flexible duct 24 either to the fixture 28 for the delivery port 22, in order to inflate the beams A, B, C . . . and to unfold the roof 1, or to the fixture 26 for the free end of the first flexible duct 23, in order to deflate the beams A, B, C . . . and to fold up the roof 1.

Figure 6:
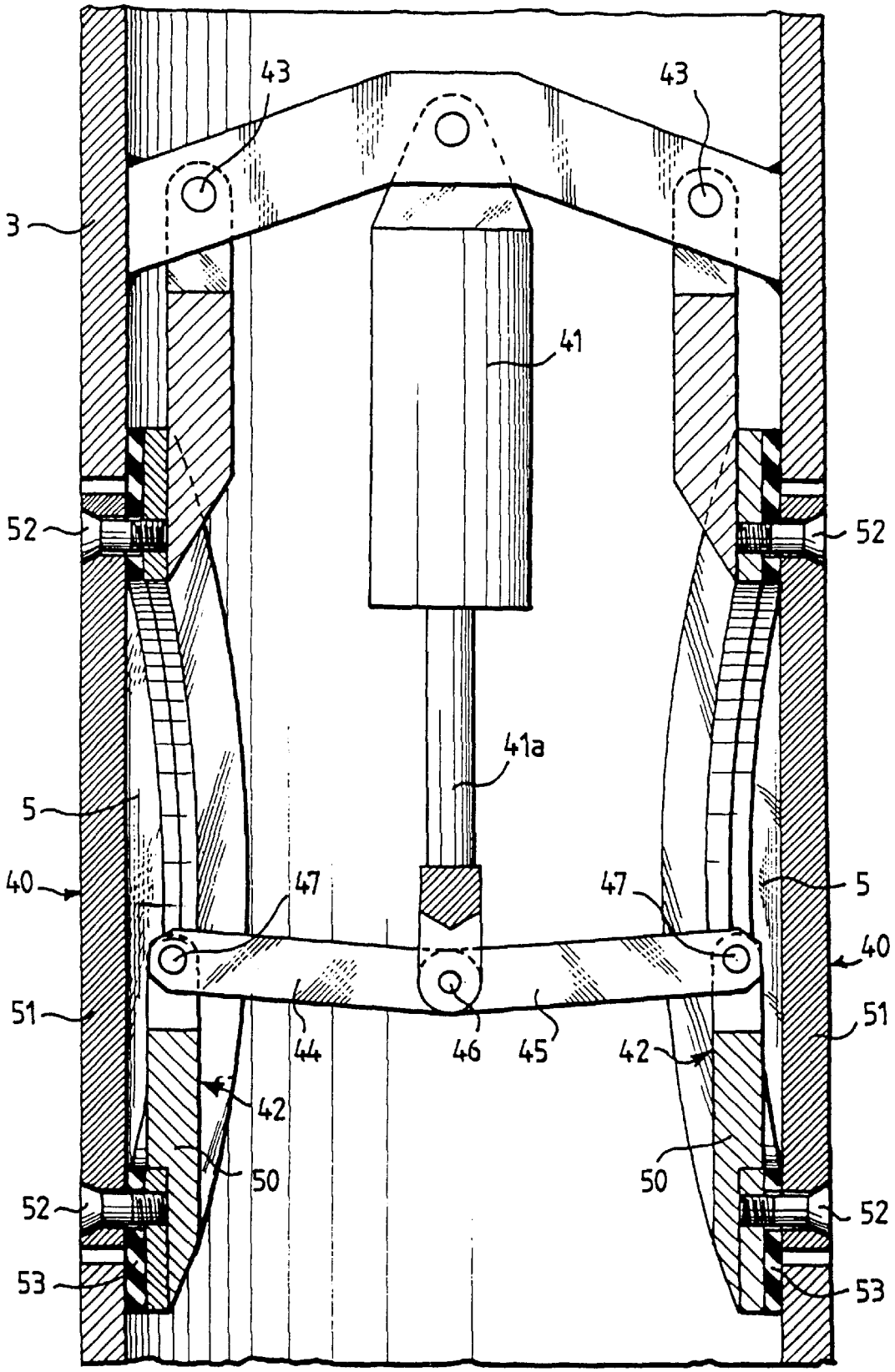
FIG. 6 is a diagrammatic cross-sectional view, in a closed position, of a first embodiment of a means for blocking off orifices in a pipe.
Figure 7:
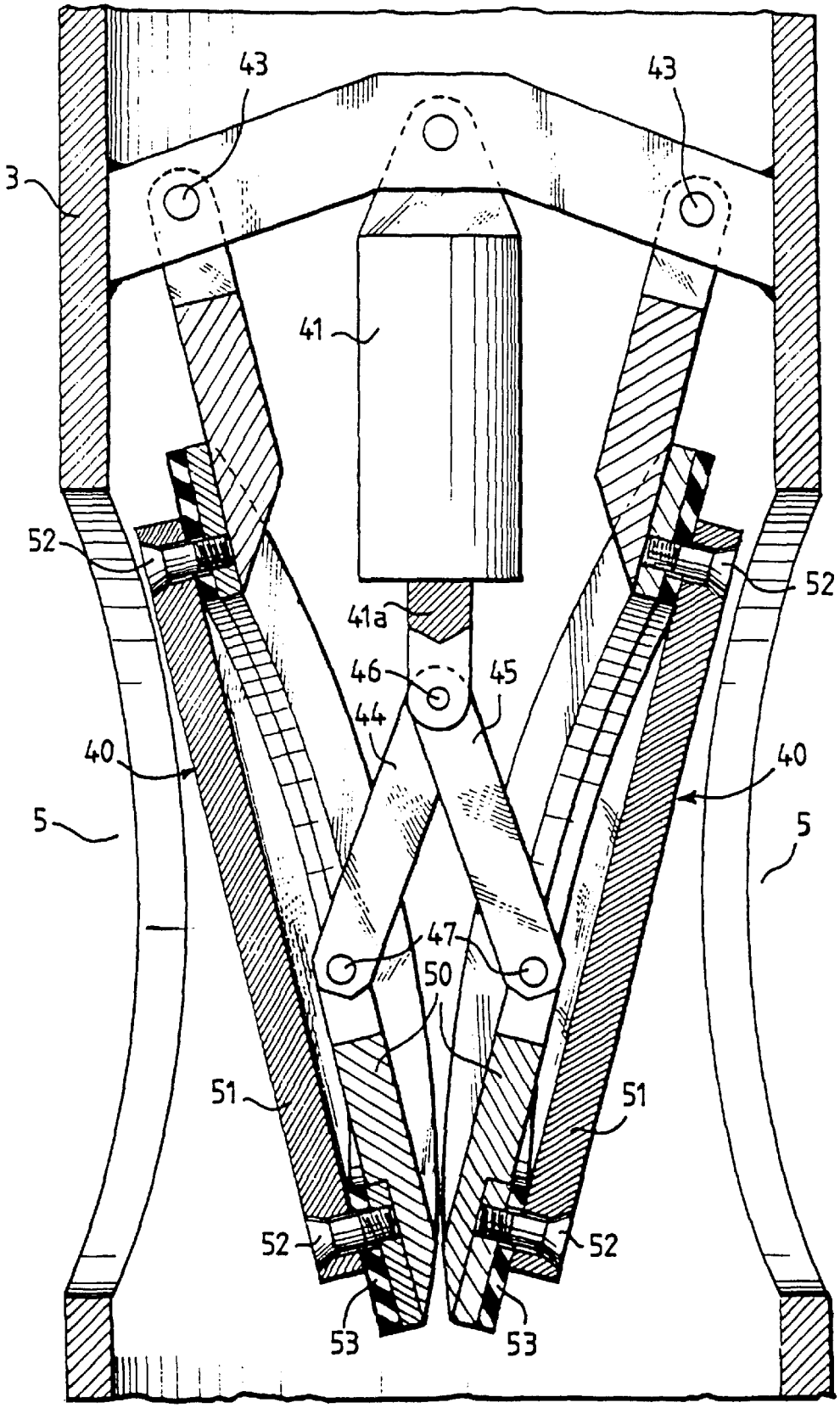
FIG. 7 is a diagrammatic cross-sectional view, in an open position, of the first embodiment of the means for blocking off the orifices in the pipe.

Referring now to FIGS. 6 and 7, the means for blocking off an orifice 5 will be described, the means for blocking off the other orifices being identical.

Each of blocking-off means is formed by sealed doors 40 associated with means 41 for opening them or for closing them.

Each sealed door 40 comprises at least one leaf 42 mounted pivotally in the pipe 3 for pivoting about a point of articulation 43 between a closed position (FIG. 6) providing continuity of the external wall of the pipe 3 and an inclined open position (FIG. 7) directing, through the corresponding orifice 5, the pressurized fluid from this pipe 3 towards the corresponding inflatable beam A, B, C . . . or from the corresponding inflatable beam A, B, C . . . towards the pipe 3.

According to the illustrative embodiment depicted in FIGS. 6 and 7, the pipe 3 includes two opposed orifices 5 equipped with leaves 42 opening towards each other and comprising a mechanism for clamping these leaves 42 in the closed position.

This mechanism for clamping the leaves 42 in the closed position is composed of two connecting rods 44 and 45 which are articulated together at one of their ends at a common point of articulation 46 and are each articulated at their other end to each of the leaves 42 at a point of articulation 47.

The means 41 for opening or for closing the leaves 42 is formed, for example, by a cylinder actuator. A free end of a cylinder actuator rod 41*a* of the cylinder is joined to the connecting rods 44 and 45 at their common point of articulation 46.

Each leaf 42 is formed by two elements 50 and 51 which can be disconnected from each other, and fastened together, by means of a plurality of screws 52 accessible from outside the pipe 3.

The first element 50 is open at its central part and carries, on the one hand, the articulations 43 and 47 and, on the other hand, a seal 53 for sealing to the internal wall of the pipe 3 over the perimeter of the orifice 5 in the pipe 3.

The separation of the second element 51 from the first element 50 makes it possible to obtain access to the interior of the pipe 3 in order to carry out maintenance on the means 41 for opening or for closing the leaves 42.

The second element 51 blocks off the central part of the first element 50 and provides continuity of the external wall of the pipe 3 in the closed position of the leaf 42, as depicted in FIG. 6.

Figure 8:
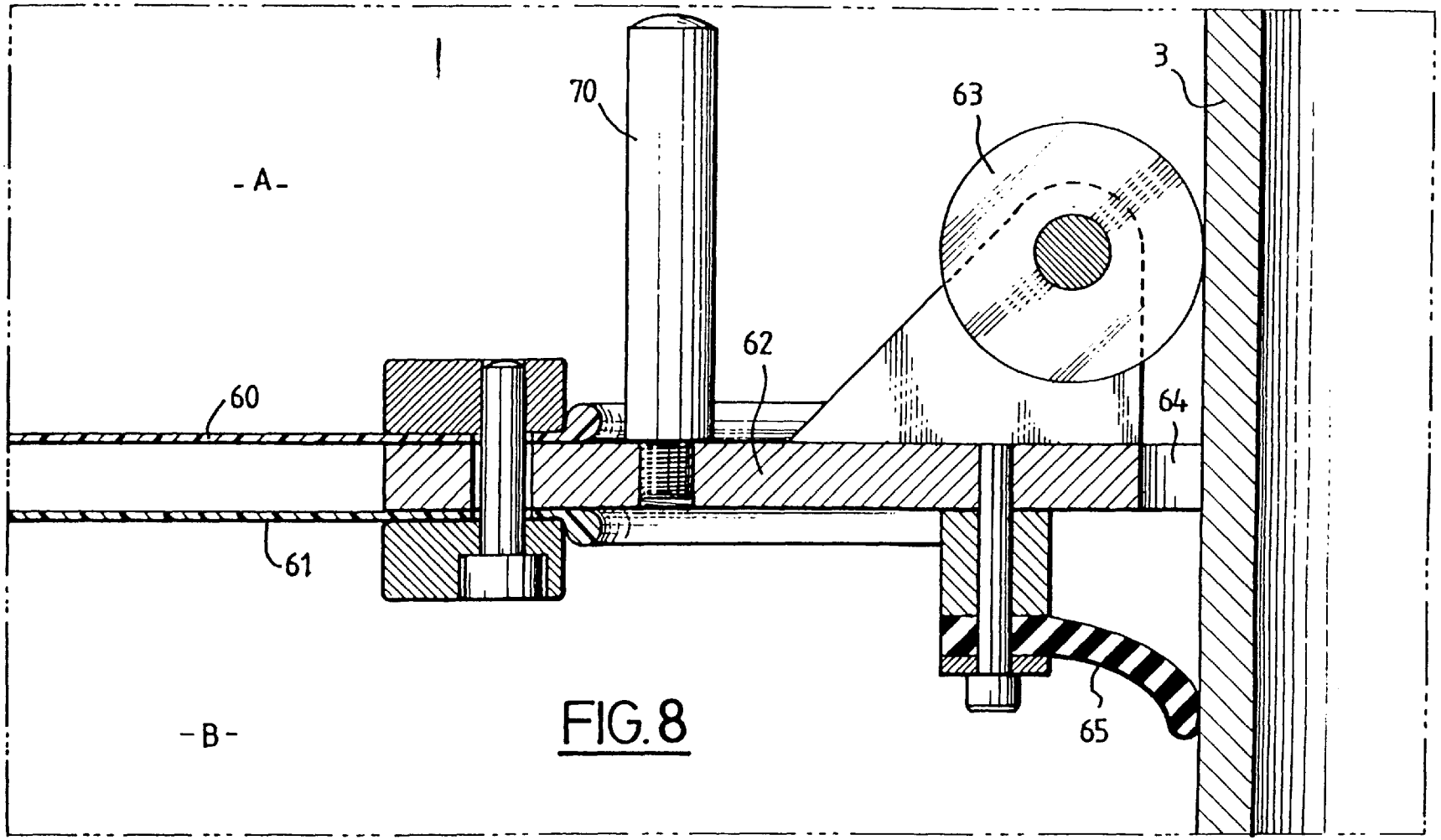
FIG. 8 is a diagrammatic cross-sectional view of a first embodiment of the means for sliding the inflatable beams along the unfolding or folding-up track.
Figure 9:
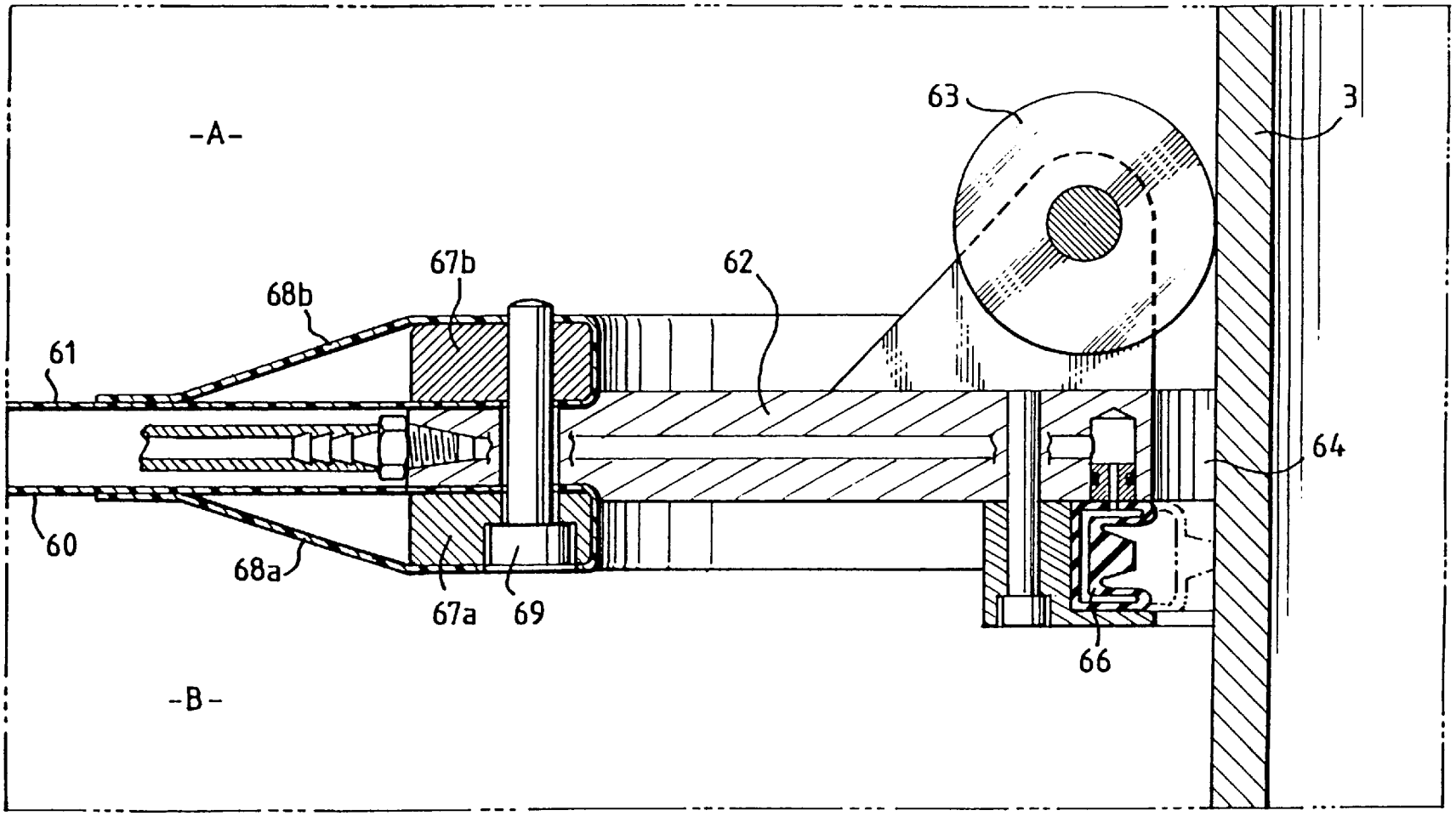
FIG. 9 is a diagrammatic cross-sectional view of a second embodiment of the means for sliding the inflatable beams along the unfolding or folding-up track.

As depicted in FIGS. 8 and 9, the contiguous walls 60 and 61 of adjacent inflatable beams, for example A and B, are sealingly joined together around the corresponding pipe 3 by using a support plate 62 carrying a sliding means constituted, for example, by a roller 63 or by a runner.

Each roller 63 is intended to roll along the external wall of the pipe 3 while the roof 1 is being unfolded or folded up.

Each support plate 62, together with the corresponding pipe 3, leaves a free space 64 allowing intercommunication between the pressurized compartments of the adjacent inflatable beams, for example A and B.

The free space 64 is completely free or permanently blocked off or momentarily blocked off, for example after the roof has been unfolded.

As depicted in FIG. 8, the free space 64 is permanently blocked off by a seal 65 fixed on the support plate 62 and rubbing against the external wall of the pipe 3 while the roof 1 is being unfolded or folded away so as to isolate the pressurized compartments of the adjacent inflatable beams, for example A and B.

As depicted in FIG. 9, the free space 64 is momentarily blocked off by a seal 66 which can be inflated and folded up.

This seal 66 is fixed on the support plate 62 The seal 66 is folded up inside of the support plate 62 in the absence of pressurization and is unfolded under the effect of its internal pressurization in order to be sealingly applied against the external wall of the pipe 3.

As depicted in FIG. 9, each of the wall of the adjacent inflatable beams, for example A and B, is sealingly secured to the support plate 62 by means of a fixture 67*a* and 67*b* held captive in an annular hem 68*a* and 68*b* formed by turning over the corresponding wall 60 and 61.

The fixtures 67*a* and 67*b* are fixed to the support plate 62 by means of a plurality of bolts 69.

Figure 2:
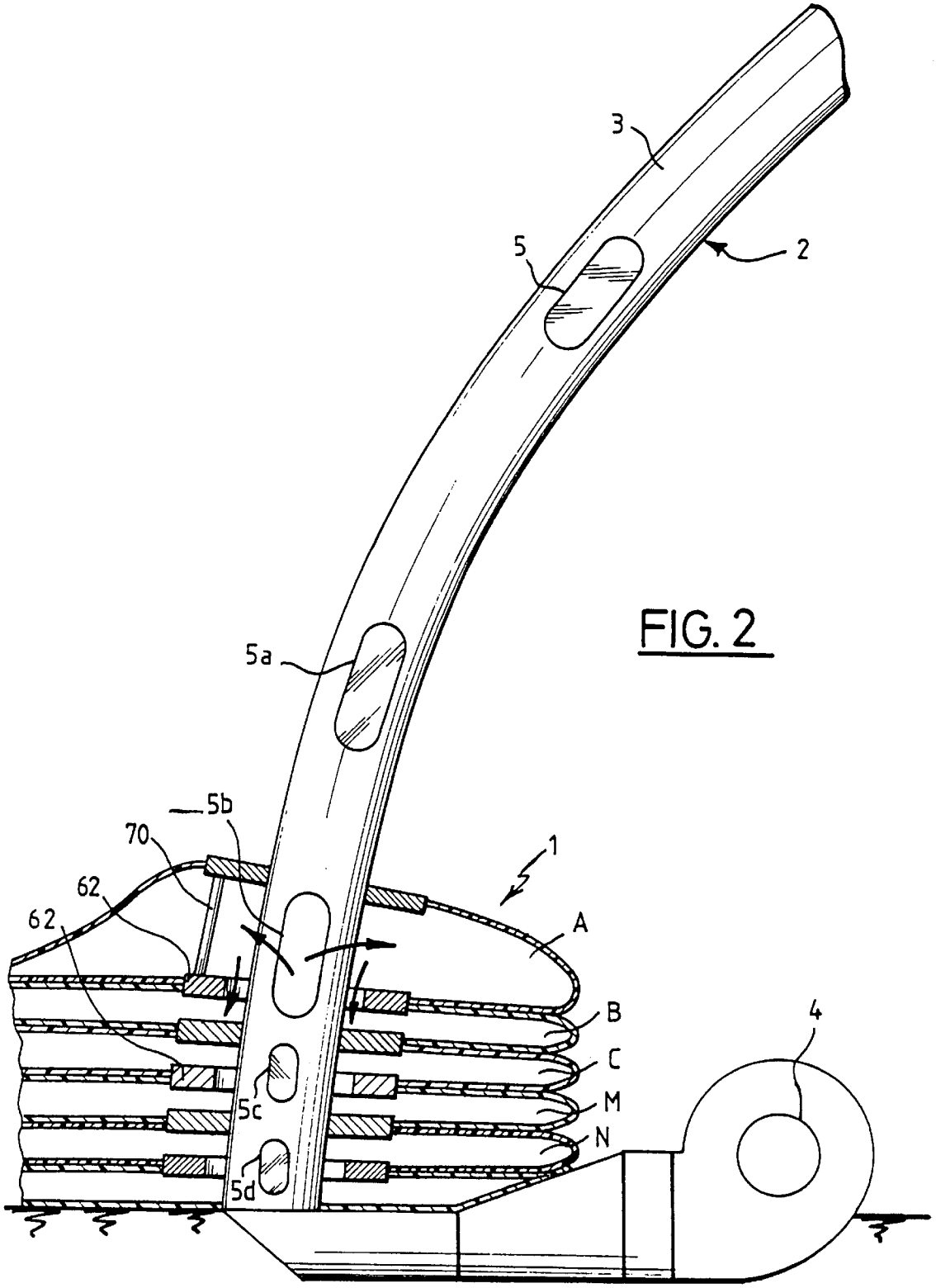
FIG. 2 is a partial diagrammatic sectional view of first ends of inflatable beams in a folded-away position.

When the beams are deflated and folded away, the adjacent support plates 62 are, as may be seen in FIGS. 2 and 8, held apart by spacers 70 by a distance such that the length of the corresponding pipe 3 lying between these adjacent support plates 62 comprises at least one part of the surface of at least one blockable orifice 5*d*, 5*c* . . .

According to an alternative form, the spacer 70 may carry a roller, not depicted, for guiding along the corresponding pipe 3.

According to another alternative form, the spacer 70 may be fixed to both of the adjacent support plates 62 of the first beam A, the length of this spacer corresponding to the separation of these support plates 62 when the first beam A is inflated.

Figure 10:
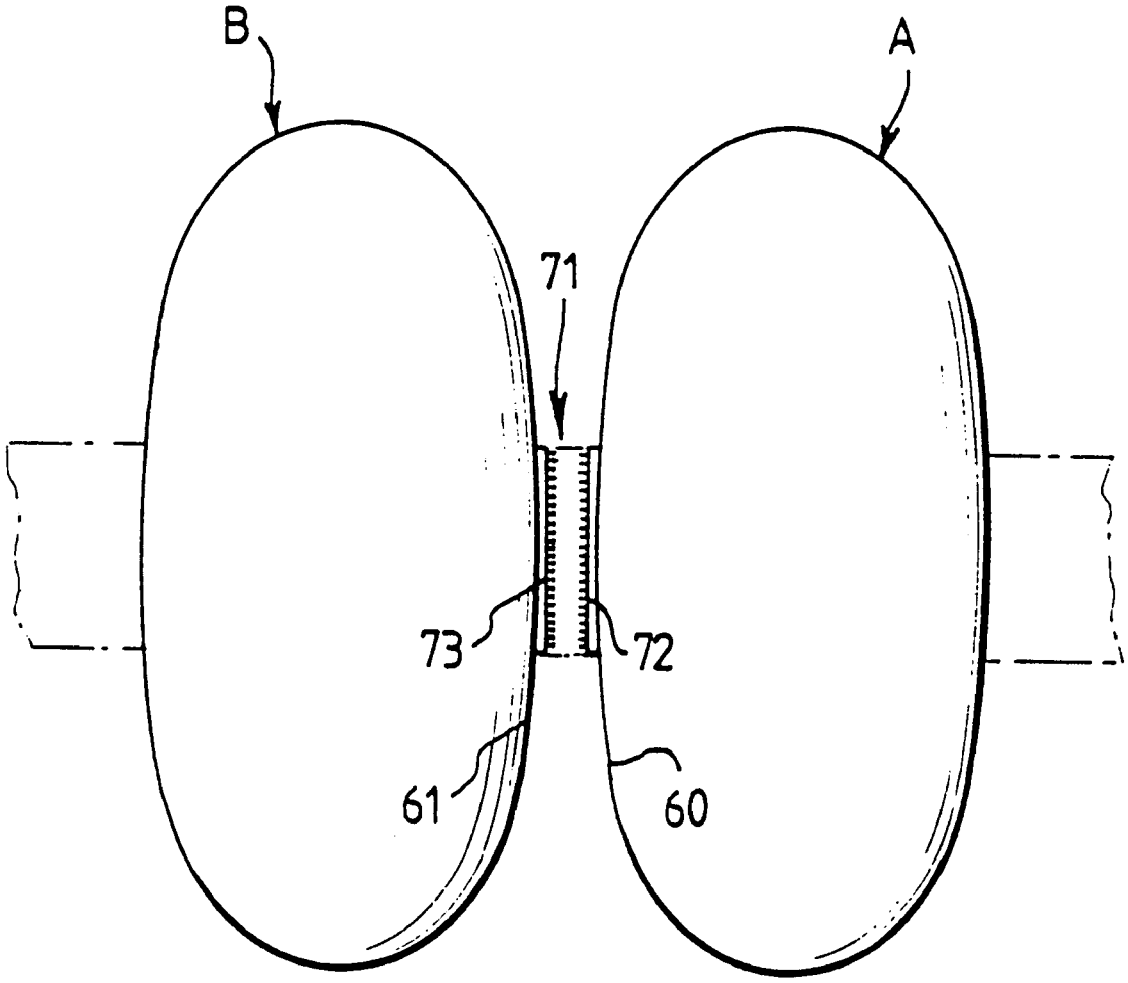
FIG. 10 is a diagrammatic cross-sectional view of two contiguous inflatable beams.

As depicted in FIG. 10, the contiguous walls 60 and 61 of the adjacent inflatable beams, for example A and B, are joined together along the space which extends between the support plates 62 and along the space between a support plate 62 and the end or ends of the inflatable beams by at least one self-grabbing tape 71.

This self-grabbing tape 71 is composed of two parts 72 and 73 which may catch on each other or be detached from each other.

Each of these parts 72 and 73 is fixed, for example, by welding at least along its longitudinal edges to each of the walls 60 and 61 of the adjacent beams, for example A and B.

In another embodiment, the contiguous walls 60 and 61 of the adjacent inflatable beams, for example A and B, are joined together by a continuous support plate, not depicted, which extends between the unfolding tracks 2 and 2*a*. In this case, each support plate comprises at each of its ends an orifice for passage of the corresponding unfolding track.

Figure 11:
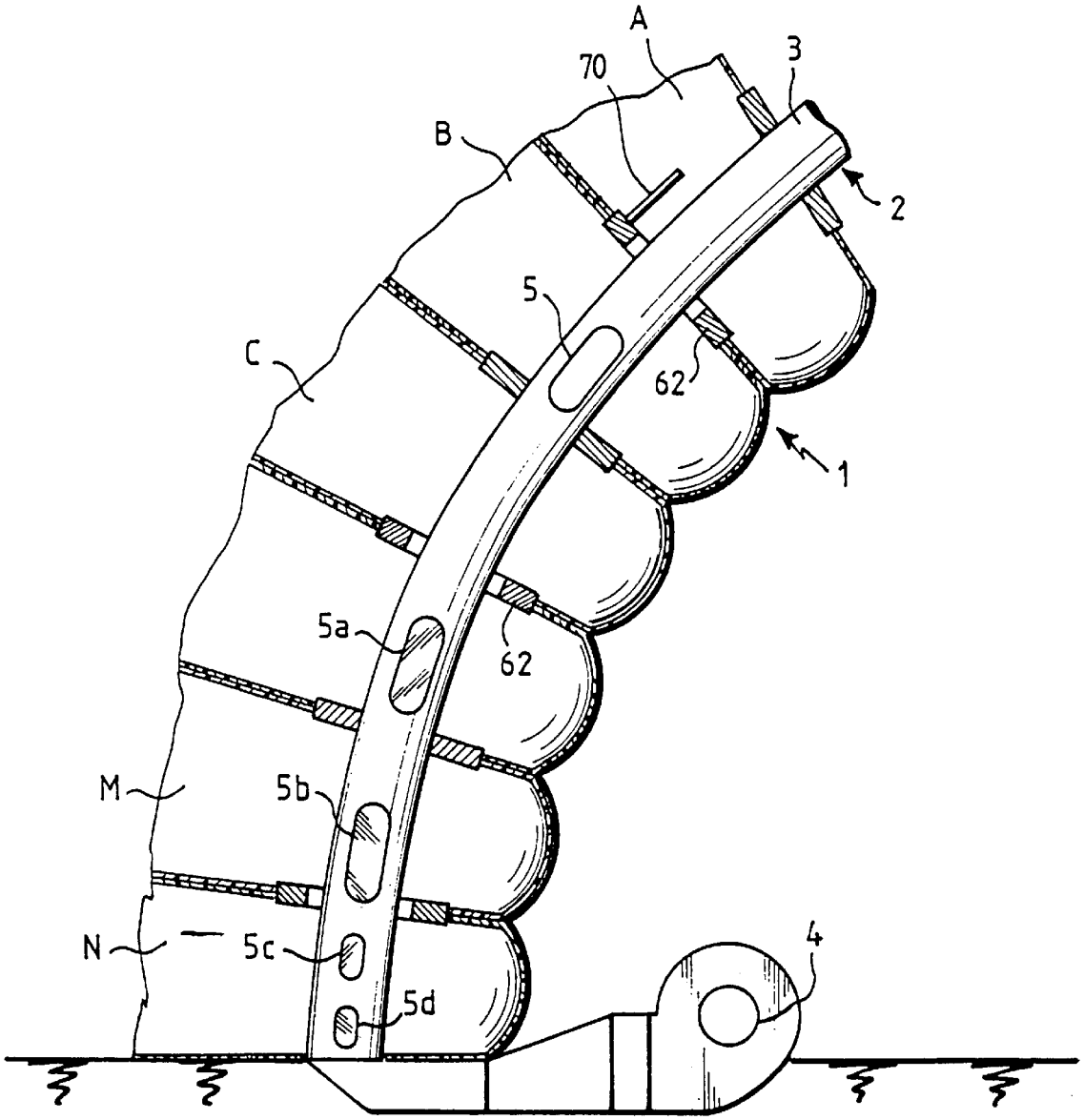
FIG. 11 is a diagrammatic partial sectional view of first ends of the inflatable beams in the unfolded position.

Referring now to the figures, and especially to FIGS. 2 and 11, the operation of the inflatable roof 1 according to the invention will be described.

In order to unfold this inflatable roof 1, the orifices 5, 5*a*, 5*c* and 5*d* are closed, by the corresponding leaves 42, and the orifice 5*b* is open.

The blower 3 operates in inflating mode and the beam A, which lies facing the open orifice 5*b*, is inflated and then the beam B is inflated since it is firstly in communication with the beam A and secondly, after starting the inflation, lies facing the open orifice 5*b*.

Next, the orifice 5*b* is closed and the orifice 5*c* is opened so as to inflate the beams C and D, and so on.

In the event of a drop in pressure, because of various leaks, or in order to pressurize the beams further after they have been unfolded, the orifice 5 is opened in order to pressurize the beams A and B or the orifice 5*a* in order to pressurize the beams C and D or the other orifices in order to pressurize the corresponding beams.

When folding away the roof 1, all the orifices 5, 5*a*, 5*b*, 5*c* . . . are closed and the blower 4 operates in suction mode.

The orifice 5*d* is firstly opened in order to deflate the beam N, and then the beam M which communicates with the beam N.

The orifice 5*d* is closed and the orifice 5*c* is opened in order to deflate the beam D, and then the beam C.

Next, the orifice 5*c* is closed and the orifice 5*b* is opened in order to deflate the beams A and B so as to fold up the entire roof.

Figure 12:
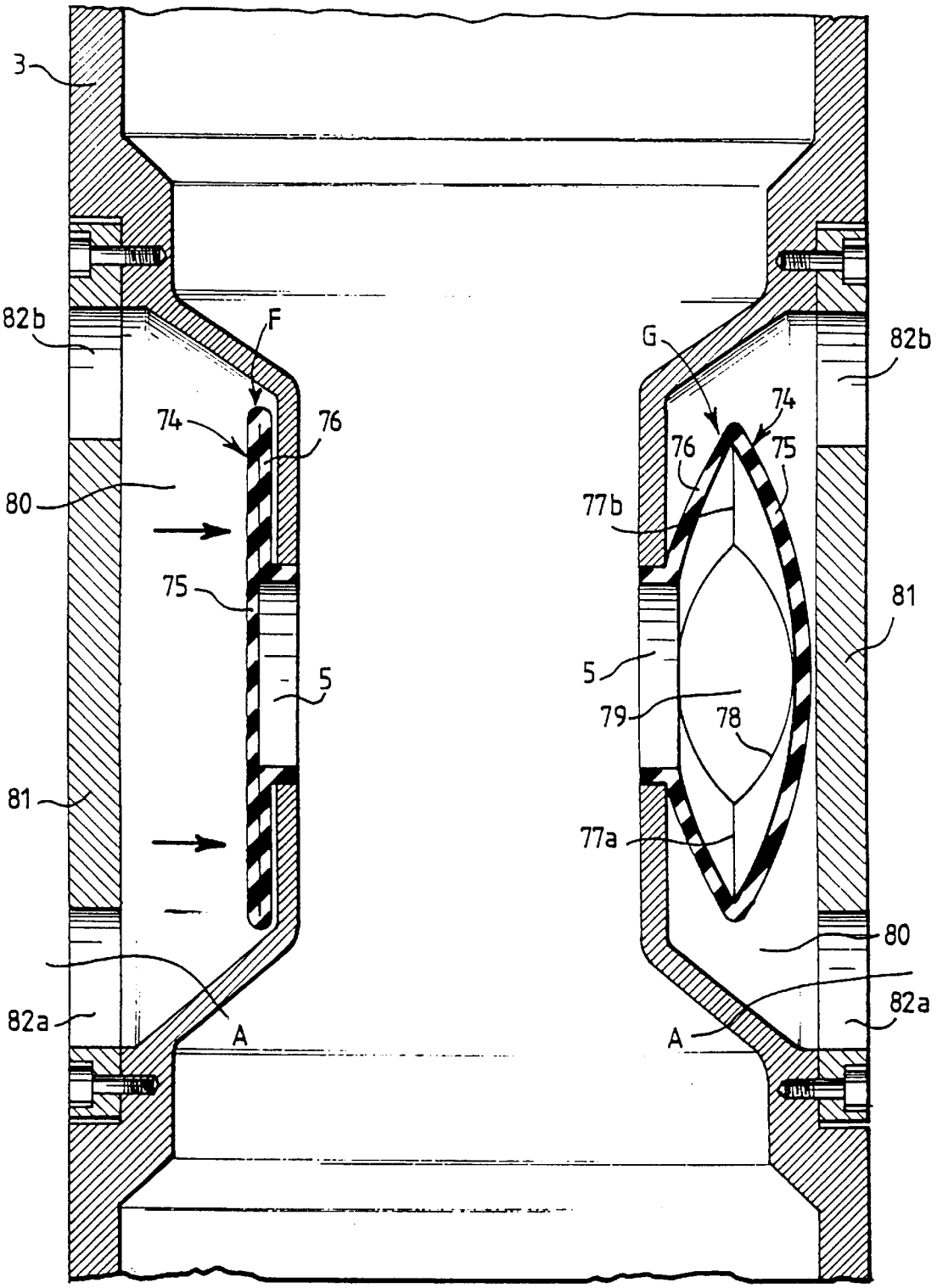
FIG. 12 is a diagrammatic cross-sectional view of a second embodiment of the means for blocking off the orifices in the pipe.

Referring now to FIG. 12, a second embodiment of the means for blocking off an orifice 5 will be described.

These blocking-off means are only used for inflating the beams A, B, C . . . M, N, these beams being deflated by another orifice 5 provided with a sealed door 40 according to the first embodiment described previously.

In this case, the blocking-off means are formed by non-return valves 74 actuated by the difference in the fluid pressures existing, on the one hand, in the pipe 3 and, on the other hand, in the at least one inflatable beam A, B, C . . . M, N.

Each non-return valve 74 comprises two associated membranes 75 and 76 made of flexible material.

The first membrane 75 blocks off the orifice 5 between the inside of the pipe 3 and the inflatable beam, for example A, and the second membrane 76 surrounds the orifice 5.

These two membranes 75 and 76 are joined together over a portion of their periphery.

For example, they are joined together in the portions 77*a* and 77*b* and are not joined together in the portion 78.

Advantageously, these two membranes 75 and 76 are arranged in a cavity 80 made in the wall of the pipe 3 and are protected by inspection doors 81 equipped with orifices 82*a* and 82*b* which bring this cavity 80 into communication with the interior of the corresponding inflatable beam, for example A.

FIG. 12 depicts, on the same pipe 3, two valves 74, one of which is in a blocking-off position F and the other one of which is in an open position G.

When the inflatable beam A is pressurized by the pressurized-fluid generator 4 operating in inflation mode, the pressure increases in the pipe 3 to a level greater than the pressure existing in this beam A and consequently in the cavity 80.

Due to the effect of this pressure difference, the membranes 75 and 76 move apart in the open position G, exposing the orifice 5 and revealing one or more openings 79 in that or those portions of the periphery of the membranes 75 and 76 where they are not joined together.

This flow of pressurized fluid then passes from the pipe 3 via the orifice 5, and then between the membranes 75 and 76 via the opening 79 and via the orifices 82*a* and 82*b* to the inflatable beam A.

When the pressurized-fluid generator 4 is stopped, the pressure drops in the pipe 3 and the pressure then existing in the inflatable beam A becomes greater than that existing in the said pipe 3.

In this case, the two membranes 75 and 76 are sealingly applied against each other in the closed position F, pressing the opening or openings 79 flat and blocking off the orifice 5.

Figure 13:
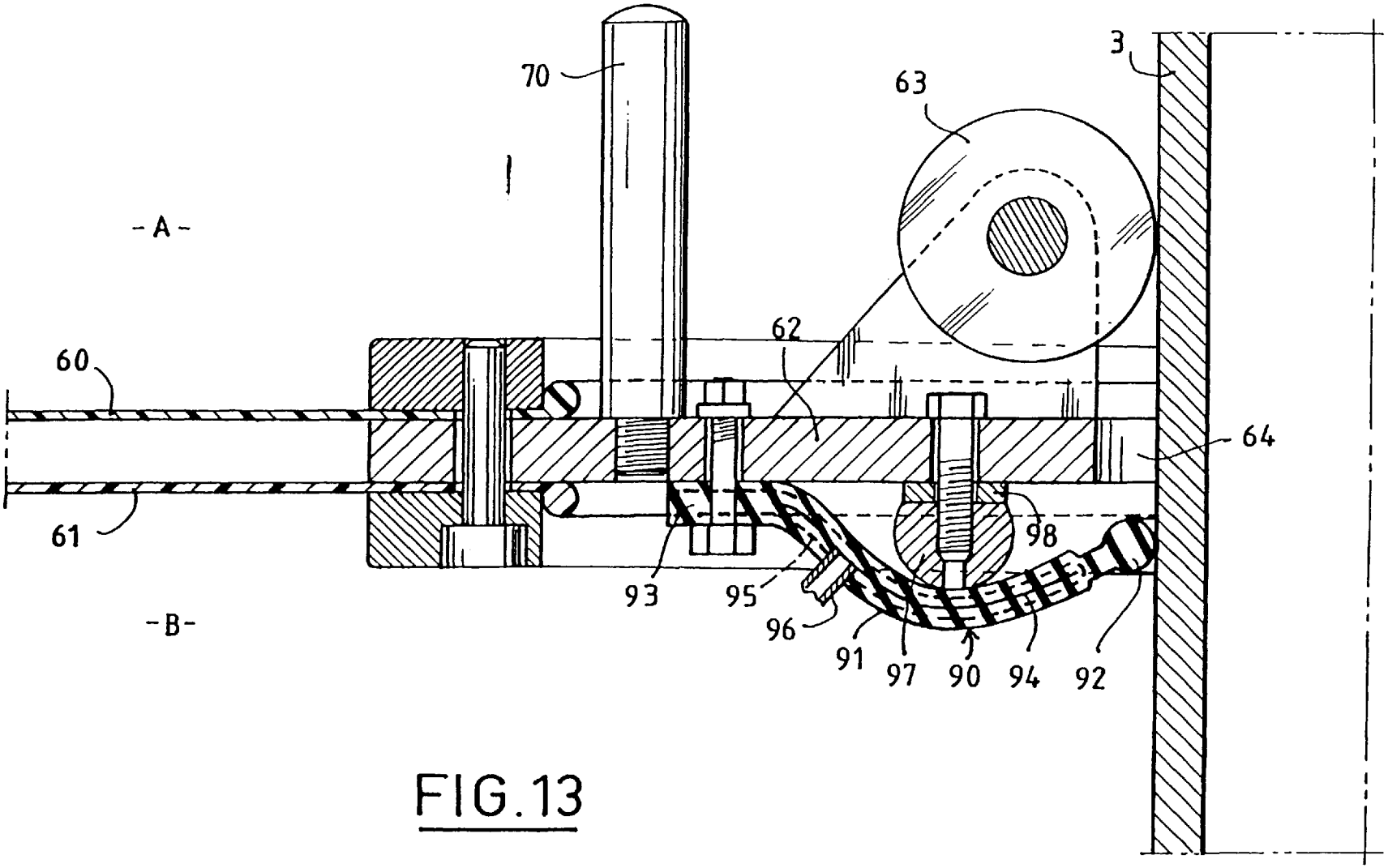
FIG. 13 is a diagrammatic cross-sectional view of an alternative form of a seal between two inflatable beams, in a deflated position.
Figure 14:
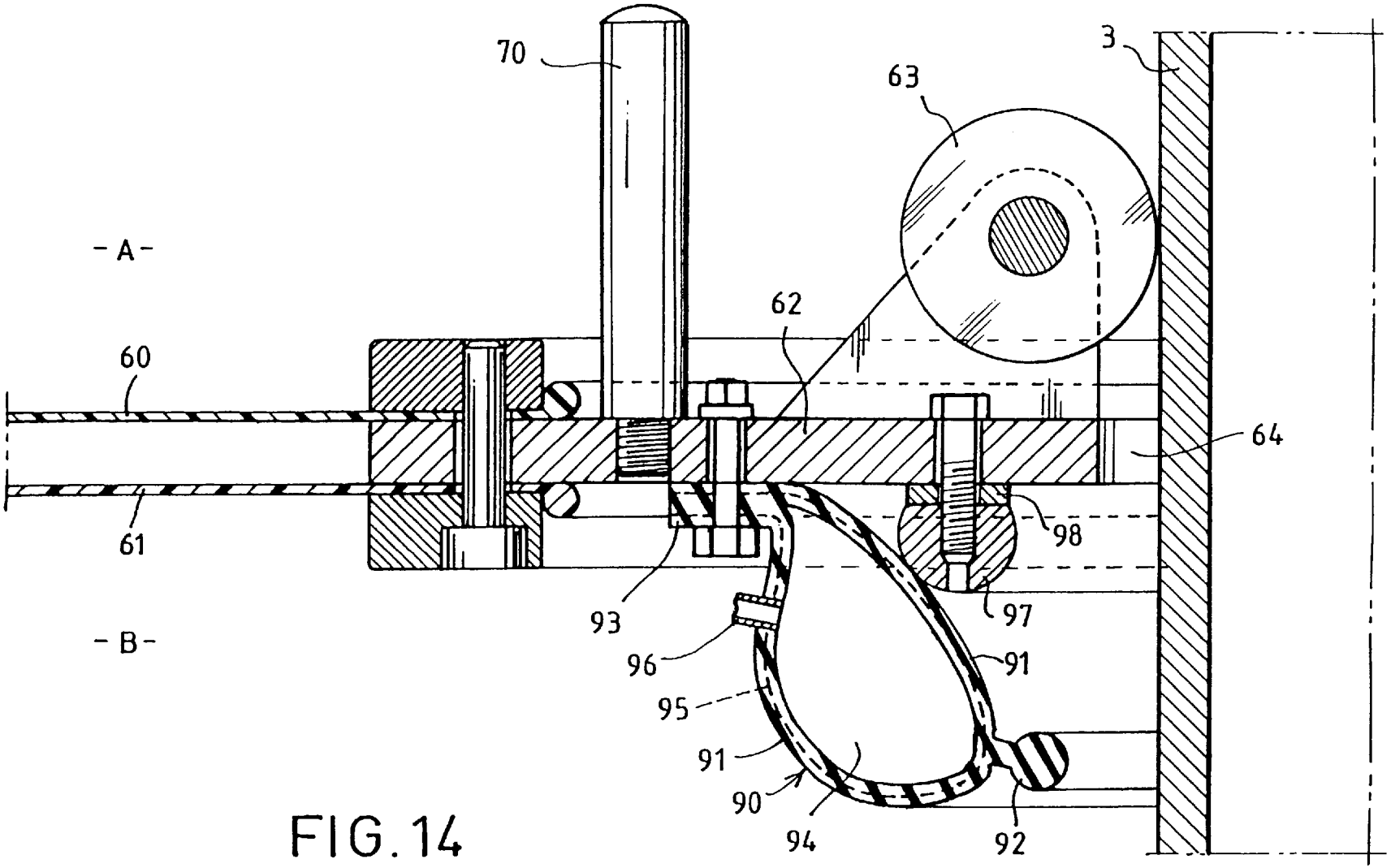
FIG. 14 is a diagrammatic cross-sectional view of the seal of FIG. 13, in an inflated position.
Figure 15:
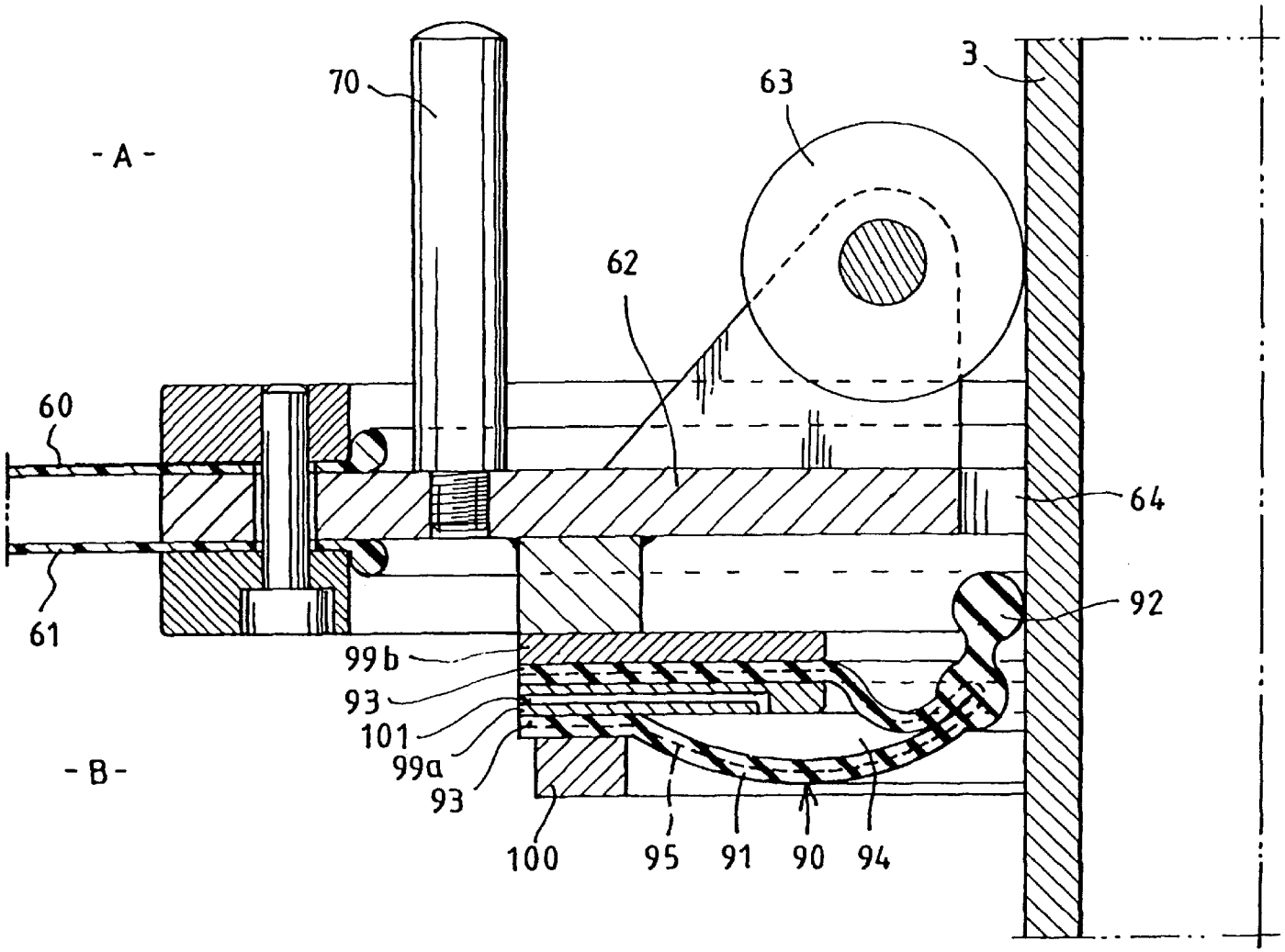
FIG. 15 is a diagrammatic cross-sectional view of another alternative form of the seal between two inflatable beams, in the inflated position.

According to an alternative form depicted in FIGS. 13 to 15, the free space 64 can be blocked off momentarily by a seal 90 formed by three concentric arts.

These three concentric parts consist of an annular double membrane 91, an elastic lip 92 formed on one of the edges of the double membrane 91, and at least one heel 93 for fixing on the support plate 62 and formed on the other edge of the double membrane 91.

This annular double membrane 91, on the inside, leaves a space 94 joined to inflating means, not depicted.

The elastic lip 92 is formed by a toroidal ring.

Moreover, the seal 90 is made from elastic gum of an elastomer or plastomer, the gum being reinforced by a web of cables 95 which are arranged radially and extend continuously into the heel 93 and the annular double membrane 91.

The cables 95 are made of metal, of textile or of glass fibers.

The annular double membrane 91 of the seal 90 can deform between a non-inflated first state (FIG. 13) providing the sealing between two adjacent beams A, B, C . . . M, N by elastic clamping of the lip 92 against the pipe 3 and an inflated second state (FIG. 14) leaving a passage between the two adjacent beams A, B, C . . . M, N.

According to a first embodiment depicted in FIGS. 13 and 14, the internal space 94 of the double membrane 91 is joined to the inflating means by a hose 96, and the pressure exerted by the elastic lip 92 on the pipe 3, when the seal 90 is in the inflated position, is adjusted by a ring 97 fastened to the support plate 62 and on which ring the seal bears in the deflated position. The position of the ring 97 with respect to the support plate 62 can be adjusted. This adjustment may possibly be achieved by means of shims 98.

According to a second embodiment, depicted in FIG. 15, one of the membranes of the double membrane 91 is arranged between two stiffening cheeks, 99*a* and 99*b* respectively, and the seal 90 is fixed on the support plate 62, at the heels 93, by a fixing member 100.

The cheek 99*a* arranged between the two membranes of the double membrane 91 comprises a conduit 101 emerging into the internal space 94 and joined to the inflating means, not depicted.

The configuration of the seal 90, inflated and folded away or deflated and applied against the pipe 3 between each beam A, B, C . . . M, N, controls the successive inflation or deflation of these beams by closing or opening the intercommunication passage 64. For the successive inflation of the beams A, B, C . . . M, N, the corresponding seal 90 is successively folded away, by inflating, and then deflated when the corresponding beam has been inflated to the desired pressure.

The sealing of the beams A, B, C . . . M, N is provided by the seals 90 which, in the deflated state, are applied, owing to their shape and their structure, against the pipe 3.

According to an alternative form, the pipe 3 for conveying the pressurized fluid is disposed in the middle of the beams A, B, C . . . M, N.

I claim:

1. An inflatable roof, which can be unfolded by being inflated and folded away by being deflated, comprising:

a plurality of longitudinal beams arranged side-by-side;

a pressurized fluid supply device fluidically coupled to said inflatable beams;

a rigid beam passing through said inflatable beams in a sealed manner, said inflatable beams being slidable along said rigid beam such that said rigid beam constitutes an unfolding and folding-up track;

wherein said rigid beam comprises a pressurized fluid conveying pipe having at least one orifice formed therein, said pipe being fluidically coupled with said pressurized fluid supply device, and said pipe being fluidically coupled with an interior of at least one of said inflatable beams via said at least one orifice; and wherein said at least one orifice is respectively equipped with at least one valve to selectively block fluid flow through said at least one orifice.

2. An inflatable roof according to claim 1, wherein said pipe is fluidically coupled to said pressurized fluid supply device at least at one end of said pipe.

3. An inflatable roof according to claim 1, wherein said pipe comprises a tube having a circular cross section.

4. An inflatable roof according to claim 1, wherein said pipe comprises a tube having a rectangular cross section.

5. An inflatable roof according to claim 1, wherein said pressurized fluid supply device comprises at least one pressurized fluid generator.

6. An inflatable roof according to claim 5, wherein said pressurized fluid generator comprises a centrifugal blower having a suction port and a delivery port;

a first flexible duct having a first end coupled to said suction port, and a second end;

a second flexible duct having a first end coupled to said pipe, and a second end; and a connection mechanism for selectively connecting said second end of said second flexible duct to said delivery port of said blower in order to inflate said inflatable beams, or to said second end of said first flexible duct in order to deflate said inflatable beams.

7. An inflatable roof according to claim 1, wherein said at least one valve comprises a sealed door openably closing said orifice, and a mechanism to move said door between open and closed positions.

8. An inflatable roof according to claim 7, wherein said door comprises a leaf pivotally mounted in said pipe for pivoting movement between the closed position in which said leaf provides continuity of an external wall of said pipe, and an open position in which said leaf is inclined to guide pressurized fluid from said pipe toward said at least one inflatable beam or from said at least one inflatable beam into said pipe.

9. An inflatable roof according to claim 1, wherein said at least one orifice comprises at least two opposed orifices, and said at least one valve comprises at least two valves respectively including leaves openable toward each other;

a mechanism is provided for clamping said leaves in the closed positions and comprises two connecting rods having first ends pivotally connected at a pivot point and second ends pivotally connected to said leaves, respectively; and a valve actuator is pivotally connected to said connecting rods at said pivot point.

10. An inflatable roof according to claim 1, wherein said at least one valve comprises at least one non-return valve actuatable by a difference between fluid pressure in said pipe and fluid pressure in said at least one inflatable beam.

11. An inflatable roof according to claim 10, wherein said at least one non-return valve comprises a first membrane for blocking said orifice, a second membrane surrounding said orifice and having a periphery joined over a portion thereof to said first membrane such that said first and second membranes are movable toward and away from each other between a closed state in which said first and second membranes are sealingly abutted against each other and block said orifice and an open state in which a space is formed between said first and second membranes so as to form an opening for passage of fluid.

12. An inflatable roof according to claim 1, wherein contiguous walls of adjacent ones of said inflatable beams are sealingly joined together around said pipe by a support plate, and a slider is carried by said support plate to slidably mount said adjacent ones of said inflatable beams to said pipe; and a free space is formed between said pipe and said support plate, and a seal is provided to block off said free space.

13. An inflatable roof according to claim 12, wherein said seal is carried by said support plate such that, upon sliding of said adjacent ones of said inflatable beams along said pipe, said seal rubs against said pipe.

14. An inflatable roof according to claim 13, wherein said seal comprises an inflatable seal.

15. An inflatable roof according to claim 12, wherein said seal comprises an inflatable seal.

16. An inflatable roof according to claim 15, wherein said seal comprises an annular double membrane having, on a first edge, an elastic lip and, on a second edge, at least one heel fixed to said support plate; and said annular double membrane defines a space therein so as to be inflatable, such that said annular double membrane can deform between a non-inflated state in which said lip is elastically held against said pipe to block said free space, and an inflated state in which said free space is unblocked.

17. An inflatable roof according to claim 16, wherein said elastic lip comprises a toroidal ring.

18. An inflatable roof according to claim 17, wherein said seal is formed of elastic gum of an elastomer or plastomer; and a web of cables is arranged in said gum radially and extending continuously into said heel, to reinforce said annular double membrane.

19. An inflatable roof according to claim 16, wherein said seal is formed of elastic gum of an elastomer or plastomer; and a web of cables is arranged in said gum radially and extending continuously into said heel, to reinforce said annular double membrane.

20. An inflatable roof according to claim 16, further comprising at least one spacer provided between adjacent ones of said support plates so as to maintain separation of said adjacent ones of said support plates by a distance such that at least a part of said at least one orifice is disposed between said adjacent ones of said support plates.

21. An inflatable roof according to claim 12, further comprising at least one spacer provided between adjacent ones of said support plates so as to maintain separation of said adjacent ones of said support plates by a distance such that at least a part of said at least one orifice is disposed between said adjacent ones of said support plates.

22. An inflatable roof according to claim 21, wherein said spacer is fixed to both of said adjacent ones of said support plates and has a length corresponding to a separation distance of said adjacent ones of said support plates when said inflatable beam between said adjacent ones of said support plates is inflated.

23. An inflatable roof according to claim 1, wherein contiguous walls of adjacent ones of said inflatable beams are joined together by at least one self-grabbing tape.

24. An inflatable roof according to claim 1, wherein said pipe is disposed in a middle portion of said inflatable beams.

* * * * *